United States Patent [19]

LaRue

[11] Patent Number: 4,680,995

[45] Date of Patent: Jul. 21, 1987

[54] SCREWDRIVER

[75] Inventor: Philip R. LaRue, Meyersdale, Pa.

[73] Assignee: Naphs, Inc., Meyerdale, Pa.

[21] Appl. No.: 833,083

[22] Filed: Feb. 24, 1986

[51] Int. Cl.[4] ..... B25F 1/00

[52] U.S. Cl. ..... 81/437; 81/186

[58] Field of Search ..... 81/436, 437, 460, 461, 81/186

[56] References Cited

U.S. PATENT DOCUMENTS 1,069,215 8/1913 Wood ..... 81/436

1,476,653 12/1923 Stanton ..... 81/436

*Primary Examiner*—Frederick R. Schmidt

*Assistant Examiner*—Bradley I. Vaught

*Attorney, Agent, or Firm*—Buell, Ziesenheim, Beck & Alstadt

[57] ABSTRACT

A screwdriver bit has a pair of opposite driving faces which taper toward each other at its bit end which faces are arcuate in form, concave-out and terminate in a bit edge which is double concave in cross section, thicker at both its ends than at its center. The center thickness is made small enough to enter the slot of small screws, and the end thicknesses are great enough that the center of the bit edge does not make contact with the slot of larger screws. A single bit can drive and remove screws of a wide range of sizes.

5 Claims, 5 Drawing Figures

SCREWDRIVER

This invention relates to hand tools. It is more particularly concerned with screwdrivers for driving and removing slotted-head machine- and wood-screws.

BACKGROUND OF THE INVENTION

Perhaps the most common tool in the machinists's or woodworker's tool kit is the screwdriver, or rather collection of screwdrivers of different sizes that an artisan must have available to drive and remove the slotted-head screws and bolts of different sizes that he regularly encounters. This range does not include screws of the sizes used by watchmakers, at one end of the scale, and the cap screws which are driven or removed with wrenches, at the other end of the scale, but for the screws of sizes between those extremes a mechanic usually carries half-a-dozen or so screwdrivers of different dimensions. This multiplication has been necessary prior to my invention to be described hereinafter because of the different widths of slots in screws of various sizes and the different torques required to tighten or loosen screws of different diameters. It has been necessary to use small screwdrivers with thin blades to engage small screws with narrow slots and large screwdrivers with thicker and wider blades to rotate large screws with wider slots.

SUMMARY OF THE INVENTION

The screwdriver bit of my invention has a pair of opposite driving faces which taper toward each other toward its bit edge. Those faces are not flat but are arcuate in form, concave-out, and terminate in a bit edge which is double-concave in cross section, thicker at both ends than it is at its center. The thickness of the bit edge at its center is made small enough to enter the slots of small screws. The thickness of the bit edge at its ends is made great enough that the center of the bit edge does not make contact with the screw slot in larger diameter screws. Thus, a single screwdriver of my invention automaticaly accomodates itself to a wide range of screw sizes and can both drive and remove those screws.

DESCRIPTION OF PREFERRED EMBODIMENT

Figure 1:
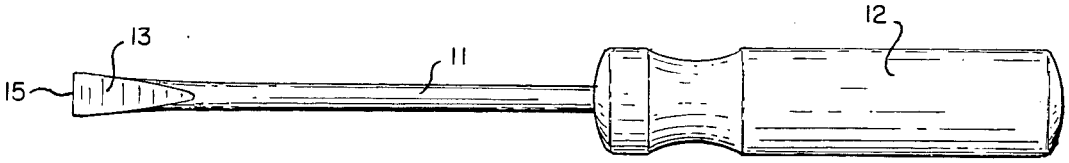
FIG. 1 is an elevation of a screwdriver of my invention.
Figure 2:
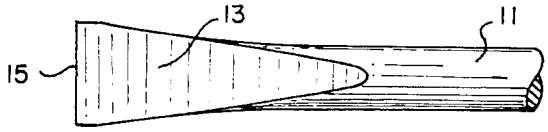
FIG. 2 is a detail of the working end of my bit of FIG. 1.
Figure 4:
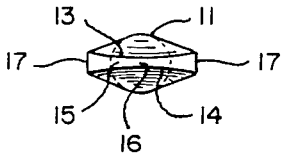
FIG. 4 is an end elevation of the working end of my bit of FIG. 3.
Figure 3:
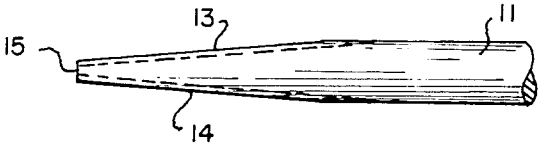
FIG. 3 is an elevation of the working end of my bit in a plane normal to the plane of FIG. 2.
Figure 5:
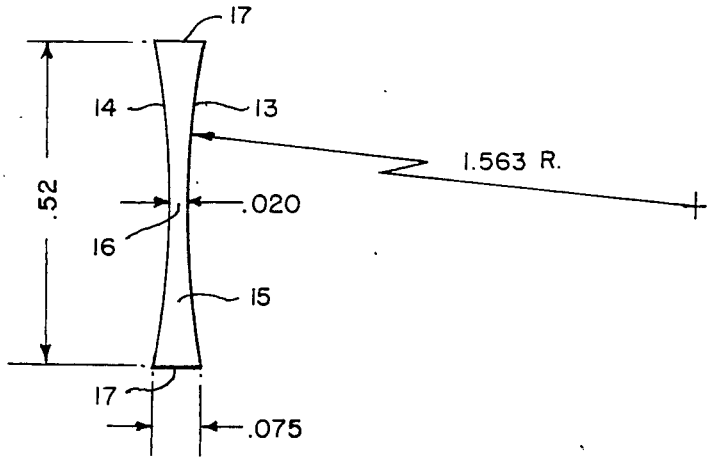
FIG. 5 is a section of my bit taken on the plane 5—5 of FIG. 1 and enlarged by a factor of 4.

An embodiment of my invention presently preferred by me is shown in the attached figures. My screwdriver comprises a shaft 11 which may be cylindrical or prismatic in shape and a handle or grip 12 which is conventional. The bit end of my tool is formed with a pair of opposite driving faces 13 and 14 shown in FIGS. 1, 2 and 3 which taper toward each other as they approach the bit edge 15. The bit end of shaft 11 is flared somewhat as is shown in FIG. 2 so that it is wider than the diameter or width of shaft 11. In a conventional screwdriver, the driving faces are flat. In my article, those faces 13 and 14 are arcuate, concave-out, as is best shown in FIG. 5. The edge 15 of my bit shown in enlarged scale in FIG. 5 is appreciably thinner at its center 16 than at either end 17. My bit, therefore, engages small screws at the center of its edge. As small screws have small diameter heads, the lateral dimension of the center portion 16 of the edge need not be very extensive.

Larger screws with wider slots have larger heads and the wider slots in those heads are engaged by the end portions 17 of my bit. The center portion 16 of my bit does not make contact with those slots.

The figures, particularly FIG. 5, illustrate the nominal dimensions of a preferred embodiment of my article. The radius of curvature of the circular arcuate driving faces 13 and 14 is 1.563 inches. The center thickness of edge 15 is 0.020 inches. The thickness at the end 17 of edge 15 is 0.075 inches. The lateral dimension of edge 15 is 0.52 inches. A single bit of those dimensions can drive and remove screws as small as No. 2 round-head machine screws, which have a minimum slot width of about 0.023 inches, and as large, or even larger, than $\frac{1}{4}$ inch diameter round-head screws or bolts which have a minimum head diameter of 0.472 minimum inches and a slot width of 0.064 inches. By varying the bit dimensions, bits of my invention can be formed which encompass other ranges of screw sizes. Small screws are usually placed closer together than large screws and, if that spacing between their heads is less than half the lateral dimension of edge 15 of my bit, it may not be feasible to use that bit of my invention, even though it is accepted by the screw head slot.

In the foregoing specification I have described a presently preferred embodiment of my invention; however, it will be understood that my invention can be otherwise embodied within the scope of the following claims.

I claim:

1. In a screwdriver bit having a shaft and driving faces disposed on opposite sides thereof said faces extending the entire width of the bit lengthwise of the bit edge, the improvement in which said oppositely disposed driving faces are concave-out arcuate faces having a radius of curvature of about 1.56 inches progressively decreasing in depth along said bit from said bit edge so as to form a bit edge having at its center a thickness of about 0.02 inches and at its ends a thickness of about 0.075 inches, whereby a single said bit is adapted to drive and to remove slotted-head screws having slots of different widths.

2. The bit of claim 1 in which said radius is between about 1.56 and 1.57 inches.

3. The bit of claim 1 in which the transverse dimension of the bit edge is about $\frac{1}{2}$ inch.

4. The bit of claim 1 including a handle for manual operation at its end opposite its bit edge.

5. The bit of claim 1 in which the transverse dimension of the bit edge from end to end is greater than the transverse dimension of its shaft.

* * * * *

UNITED STATES PATENT AND TRADEMARK OFFICE

CERTIFICATE OF CORRECTION

PATENT NO. : 4,680,995

DATED : July 21, 1987

INVENTOR(S) : PHILIP R. LARUE

It is certified that error appears in the above-identified patent and that said Letters Patent is hereby corrected as shown below:

Column 2, line 29, delete the second occurrence of "minimum" and in line 30 insert --minimum-- before the word "slot".

Column 2, line 44, Claim 1, after "thereof" insert --,--.

Signed and Sealed this

Fifth Day of January, 1988

*Attest:*

*Attesting Officer*

DONALD J. QUIGG

*Commissioner of Patents and Trademarks*